US007983603B2

(12) United States Patent
Kimura et al.

(10) Patent No.: US 7,983,603 B2
(45) Date of Patent: Jul. 19, 2011

(54) TONER CARTRIDGE, DEVELOPING DEVICE AND IMAGE FORMING APPARATUS ALLOWING ACCURATE CONTROL OF TONER REPLENISH AMOUNT

(75) Inventors: Takahiko Kimura, Ikoma (JP); Tomoya Usui, Yamatokoriyama (JP); Teruyoshi Sudoh, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 192 days.

(21) Appl. No.: 12/396,167

(22) Filed: Mar. 2, 2009

(65) Prior Publication Data

US 2009/0220285 A1 Sep. 3, 2009

(30) Foreign Application Priority Data

Mar. 3, 2008 (JP) ..... 2008-052526

(51) Int. Cl.
*G03G 15/08* (2006.01)

(52) U.S. Cl. ..... 399/263; 399/252; 399/254; 399/255; 399/258; 399/260; 399/262

(58) Field of Classification Search ..... 399/252, 399/254–255, 258, 260, 262, 263
See application file for complete search history.

(56) References Cited

U.S. PATENT DOCUMENTS

| | | | | |
|---|---|---|---|---|
| 5,835,828 | A * | 11/1998 | Jyoroku | 399/263 |
| 6,229,976 | B1 | 5/2001 | Kimura | |
| 2007/0269238 | A1* | 11/2007 | Sato | 399/263 |
| 2008/0170890 | A1 | 7/2008 | Nishimura et al. | |

FOREIGN PATENT DOCUMENTS

| | | | |
|---|---|---|---|
| JP | 63-18380 | A | 1/1988 |
| JP | 2000-66561 | A | 3/2000 |
| JP | 2001-83787 | A | 3/2001 |
| JP | 2001-83802 | A | 3/2001 |
| JP | 2001-215781 | A | 8/2001 |
| JP | 2006-184420 | A | 7/2006 |
| JP | 2008-197636 | A | 8/2008 |

* cited by examiner

*Primary Examiner* — Ryan D Walsh
(74) *Attorney, Agent, or Firm* — Birch, Stewart, Kolasch & Birch, LLP

(57) ABSTRACT

A toner cartridge includes: a toner holding container having an outlet formed thereon; a partition wall separating the inside of toner holding container to a toner discharging portion in which the outlet is formed and a toner stirring portion other than the toner discharging portion; a toner discharging member axially and rotatably supported in the toner discharging portion for carrying the toner contained in the toner discharging portion to the outlet; a toner stirring member axially and rotatably supported in the toner stirring portion for stirring and carrying to the toner discharging portion the toner in the toner stirring portion; and an upper lid with a recess formed to surround, like a tunnel, the toner discharging member at a portion above the outlet, together with the partition wall and the toner holding container.

21 Claims, 14 Drawing Sheets

TONER CARTRIDGE, DEVELOPING DEVICE AND IMAGE FORMING APPARATUS ALLOWING ACCURATE CONTROL OF TONER REPLENISH AMOUNT

CROSS-REFERENCE TO RELATED APPLICATION

This nonprovisional application claims priority under 35 U.S.C. §119(a) on Patent Application No. 2008-052526 filed in Japan on Mar. 3, 2008, the entire contents of which are hereby incorporated by reference.

BACKGROUND OF THE INVENTION

1. Field of the Invention

The present invention relates to a toner cartridge provided in an image forming apparatus and, more specifically, to a toner cartridge, a developing device and an image forming apparatus allowing accurate control of toner replenish amount.

2. Description of the Background Art

An image forming apparatus utilizing static electro-photographic system generally forms an image on a sheet of recording paper through charging, exposing, developing, transferring, fixing, cleaning and neutralizing steps. At the charging step, a surface of a photoreceptor drum, which is driven to rotate, is uniformly charged by a charging device. At the exposure step, the charged surface of photoreceptor drum is irradiated with laser beam by an exposure device, whereby an electrostatic latent image corresponding to image information is formed. At the developing step, the electrostatic latent image formed on the surface of photoreceptor drum is developed by a developing device and a toner image is formed. At the transferring step, the toner image formed on the surface of photoreceptor drum is transferred to the sheet of recording paper by a transferring device. At the fixing step, the transferred toner image is fixed by a fixing device on the sheet of recording paper, by the application of heat and pressure. At the cleaning step, toner left on the surface of photoreceptor drum after transfer of the toner image is removed by a cleaning device, so that the surface of photoreceptor drum is cleaned. The toner removed at this time is recovered to a prescribed recovering unit. At the neutralizing step, charges left on the cleaned surface of photoreceptor drum are removed by a neutralizer, to be ready for the next image formation.

In the image forming apparatus as such, the electrostatic latent image is developed, using as the developer, a one-component developer consisting only of toner, or a two-component developer consisting of toner and carrier. Use of one-component developer is advantageous in that a stirring mechanism for uniformly mixing toner and carrier is unnecessary and, therefore, the developing device comes to have a simple structure and hence the developing device can be made smaller, whereas it is disadvantageous in that amount of toner charges tends to be unstable. Use of the two-component developer is disadvantageous in that a stirring mechanism for uniformly mixing toner and carrier is necessary and, therefore, the developing device comes to have a complicated structure and the developing device comes to have a larger size, while it is advantageous in that amount of toner charges is stable and well suited for use in a high-speed machine. Therefore, the two-component developer is often used in a high-speed image forming apparatus and a color image forming apparatus.

Recently, in order to meet users' demand for higher image quality and low energy consumption, toner of small grain size having low softening temperature and volume-average grain size of about 5 μm to about 9 μm is often used. The toner of small grain size allows fixing at a low temperature, and well attains higher resolution and lower feeling of granularity, leading to higher image quality.

The toner in developer is consumed at every developing operation. Therefore, a toner cartridge is provided in the developing device, for replenishing toner to the developing device in accordance with the consumed amount of toner. In a conventional toner cartridge, a toner outlet is formed at one end of a toner discharging member for carrying the toner to the toner outlet and, therefore, much toner tends to be accumulated at said one end of the toner discharging member, that is, the terminating end of toner carrying direction, resulting in a problem that toner clogs. Further, since the toner is carried in one direction, excessive load tends to be imposed on the toner on the terminating end of toner carrying direction and, in addition, there is a stress caused by friction with the toner discharging member. As a result, agglomeration of toner possibly occurs, or external additive to the toner undesirably enters inside the toner, so that toner characteristics tend to deteriorate.

Referring to FIG. 1, by way of example, Japanese Patent Laying-Open No. 2001-83802 (hereinafter referred to as "'802 application") discloses a toner cartridge 13 as a solution to the above-described problem, in which a toner outlet 15 is provided on the side of a central portion in the longitudinal direction of a first stirring and carrying member 17 as the toner discharging member, and a toner carrying part 19 is formed on the first stirring and carrying member 17 such that toner carrying direction is reversed substantially at the center in the longitudinal direction thereof, whereby the toner comes to be carried to the central portion in the longitudinal direction of first stirring and carrying member 17.

Further, Japanese Patent Laying-Open No. 63-18380 (hereinafter referred to as "'380 application") discloses a toner cartridge formed such that the volume near the toner outlet is made smaller than the volume of other portions.

While the toner of small grain size has superior characteristics to attain higher image quality and realizes fixing at a low temperature, it has low fluidity. Therefore, it is difficult by the conventional toner cartridge such as disclosed in '802 and '380 applications to control amount of toner to be replenished to the developing device. Particularly, it is difficult to accurately control the amount of toner replenishment, as an accidental toner leakage occurs while toner is not replenished.

SUMMARY OF THE INVENTION

An object of the present invention is to provide a toner cartridge, developing device and image forming device, allowing accurate control of toner replenish amount.

According to an aspect, the present invention provides a toner cartridge, including: a toner holding container containing toner inside and having a toner outlet formed to discharge contained toner; a partition wall separating the inside of the toner holding container to a toner discharging portion in which the toner outlet is formed, and a toner stirring portion other than the toner discharging portion; a toner discharging member axially supported in the toner discharging portion to be rotatable about a first rotation shaft, for carrying the toner contained in the toner discharging portion to the toner outlet; a toner stirring member axially supported in the toner stirring portion to be rotatable about a second rotation shaft, for stirring and carrying to the toner discharging portion the toner in the toner stirring portion; and a cover member surrounding, together with the partition wall and the toner holding container, the toner discharging member at a portion above the toner outlet, like a tunnel.

This makes it more difficult for air to enter the toner around the toner outlet from above the toner outlet. Therefore, accidental leakage of toner from the toner outlet when toner is not replenished, that is, when rotations of toner discharging member and toner stirring member are stopped, can be prevented. As a result, it becomes possible to accurately control the amount of toner replenished to the developing device.

Further, as the inside of toner holding container is separated by the partition wall to the toner discharging portion and the toner stirring portion, the toner discharging member does not much receive the weight (gravity) of toner contained in the toner stirring portion. Therefore, the stress imposed on the toner because of friction with the toner discharging member can be reduced, and degradation of toner characteristics can be prevented.

Preferably, the partition wall has a height higher than a vertical upper end of the toner discharging member. Therefore, it becomes possible to prevent the carried toner from being returned from the toner discharging portion to the toner stirring portion. As a result, it is possible to hold an appropriate amount of toner in the vicinity of toner discharging member and, hence, it becomes possible to carry toner efficiently and stably by the toner stirring member and the toner discharging member. Further, entrance of air to the toner around the toner outlet becomes less likely and, therefore, accidental leakage of toner from the toner outlet can more effectively be prevented.

Preferably, the toner outlet is formed at a position corresponding to a central portion in axial direction of the toner discharging member. Therefore, as compared with an example in which it is formed at a position corresponding to an end in the axial direction, opposite ends of tunnel-like enclosure can be opened. Therefore, it becomes possible to prevent toner from being locally accumulated near the end in the axial direction of toner discharging member. As a result, it becomes possible to prevent rotation failure caused by toner clogged in the bearing supporting the toner discharging member, particularly when the toner cartridge is transferred.

More preferably, the toner discharging member has a toner carrying unit formed as a spiral around the first rotation shaft; and direction of inclination of the spiral of toner carrying unit is set such that the toner is carried from axially opposite ends of the toner discharging member toward the toner outlet.

Consequently, the toner comes to be carried in two directions toward the toner outlet. Therefore, as compared with when the toner is carried in one direction, the amount of air introduced from above the toner outlet can further be reduced. As a result, accidental leakage of toner from the toner outlet can more effectively be prevented. Further, the number of rotations and speed of rotation of toner discharging member can be reduced and, therefore, load on the toner imposed at the terminal end in the toner carrying direction can be reduced. As a result, agglomeration of toner and undesired entrance of external additive to the inside of toner can be prevented, and therefore, toner with degraded characteristics can be reduced.

More preferably, the cover member is provided on an upper inner wall of the toner holding container, and formed such that on a phantom plane parallel to the longitudinal and height directions of the toner holding container, a bottom corner of the cover member has a right angle.

In this manner, by changing the shape at the bottom corner of cover member, the amount of toner carried by the toner discharging member to the toner outlet can be controlled. Therefore, even when the toner amount is large, the amount of supplied toner can be made stable.

More preferably, on a phantom plane parallel to the longitudinal and height directions of said toner holding container, an angle formed by a line connecting one end of an opening of the toner outlet and one end of the bottom of the cover member at a closest position to said one end and the bottom surface of the toner holding container is formed to be smaller than an angle of repose of the toner.

Therefore, the amount of air introduced from above the toner outlet can further be reduced, and accidental leakage of toner from the toner outlet can more effectively be prevented.

The developing device in accordance with another aspect of the present invention includes the toner cartridge as described above. Therefore, it is possible to maintain toner density and toner amount in the developing device at a constant state. As a result, a toner image with stable toner density can be formed.

The image forming apparatus in accordance with a further aspect of the present invention includes the developing device as described above. Therefore, a stable image quality free from fog or uneven image density can be realized.

According to the present invention, the cover member provided on the toner cartridge, together with the partition wall and the toner holding container, surrounds as a tunnel the toner discharging member for carrying the toner to the toner outlet, provided at an upper portion of the toner outlet. This makes it more difficult for air to enter from above the toner outlet to the toner around the toner outlet, and therefore, accidental leakage of toner from the toner outlet can be prevented in the state in which toner is not replenished, that is, when the rotations of toner stirring member and the toner discharging member are stopped. This enables accurate control of the amount of toner supplied to the developing device.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
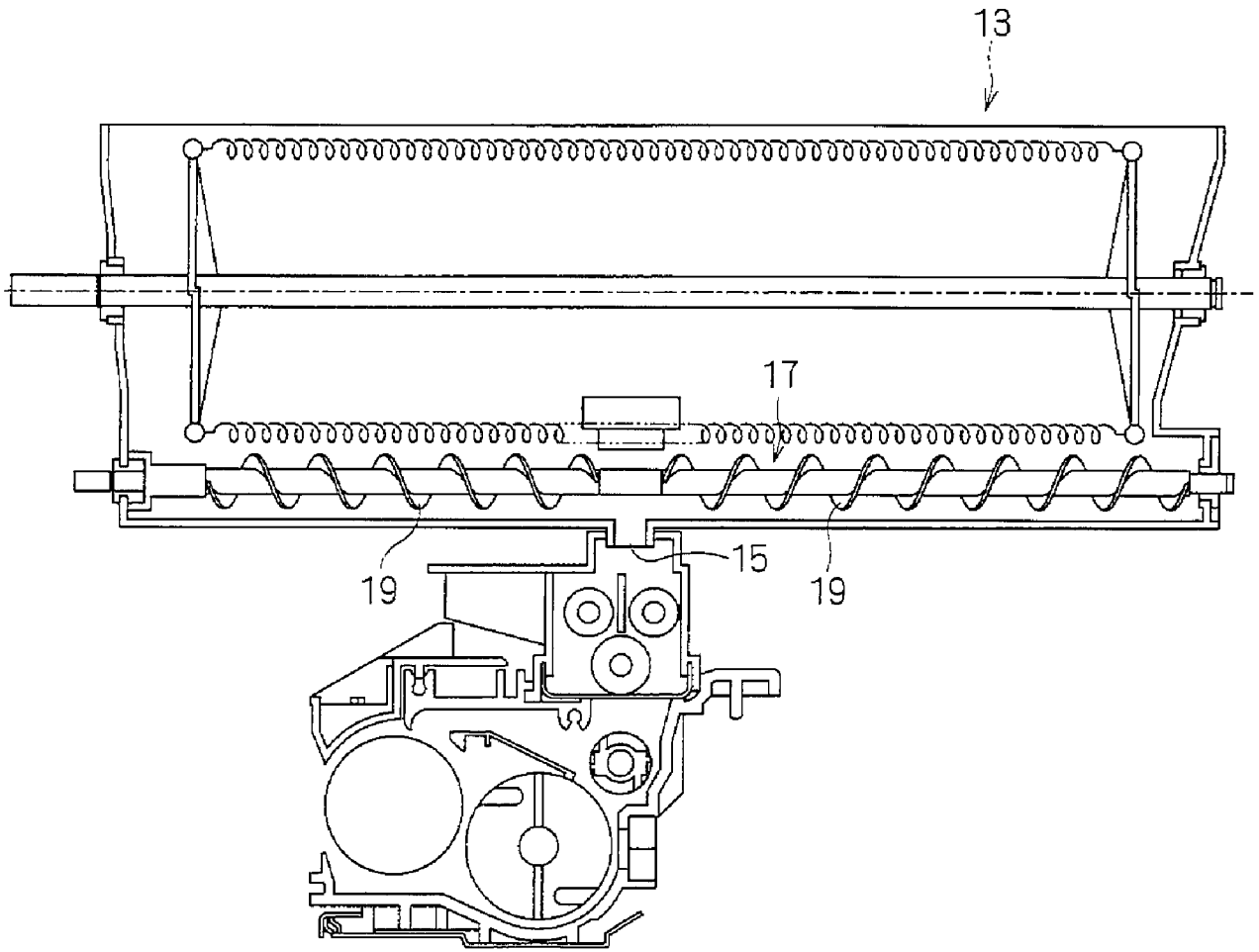
FIG. 1 PRIOR ART
FIG. 1 is a cross-sectional view showing an exemplary structure of a conventional toner cartridge.

In the following description and in the drawings, the same components are denoted by the same reference characters and same names. They have the same functions. Therefore, detailed description thereof will not be repeated.

<Structure>

[Image Forming Apparatus 20]

Figure 2:
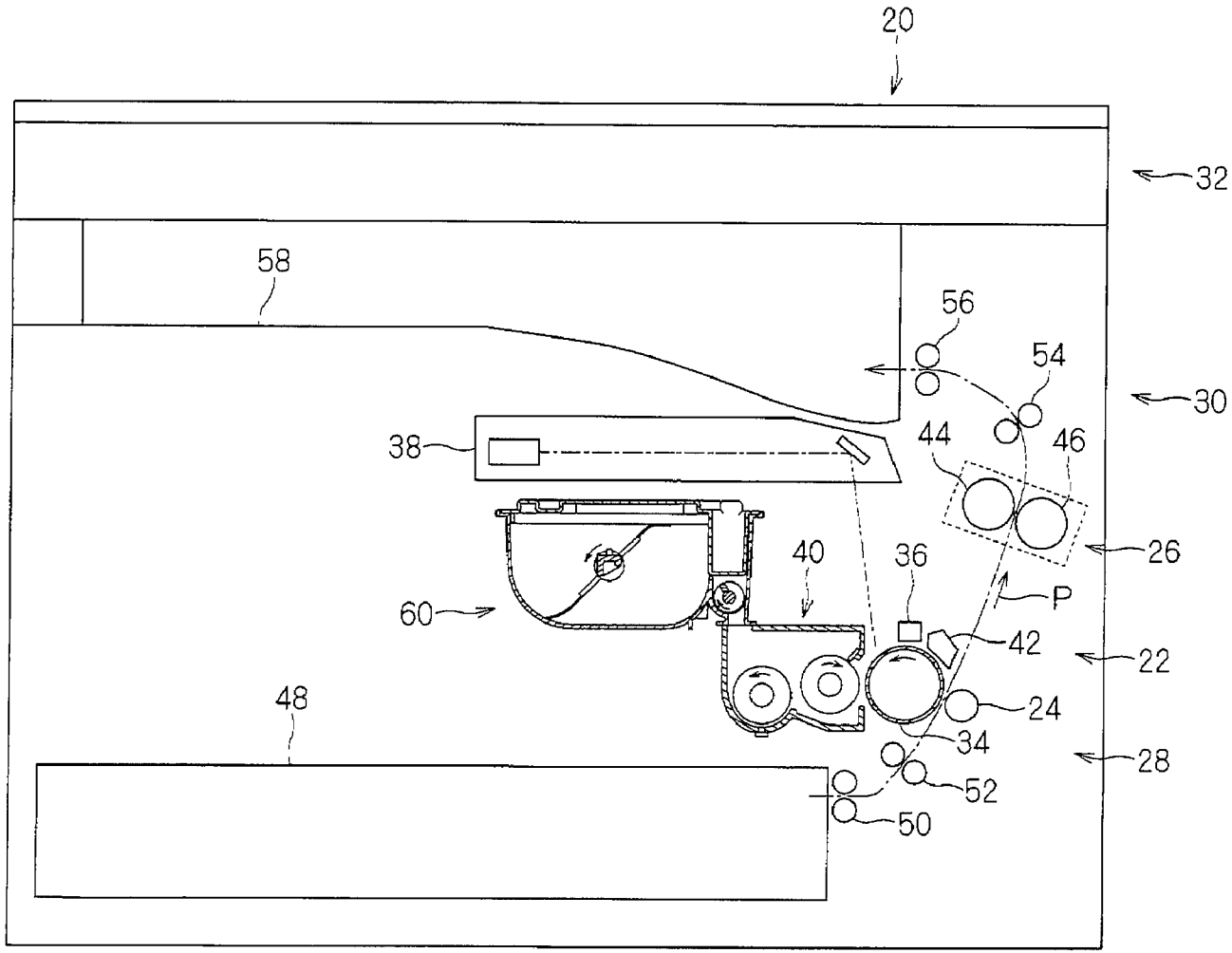
FIG. 2 schematically shows a structure of an image forming apparatus in accordance with an embodiment of the present invention.

Referring to FIG. 2, image forming apparatus 20 is, for example, a multifunctional printer of electro-photographic system, having the functions of a copying machine, a printer and a facsimile. Image forming apparatus 20 includes a toner image forming unit 22, a transfer device 24, a fixing device 26, a recording paper supplying unit 28, a discharging unit 30, a scanner unit 32, and a control unit (not shown). Image forming apparatus 20 forms a monochrome or a single color image on a sheet of recording paper, in accordance with input image information.

Toner image forming unit 22 includes a photoreceptor drum 34, a charging device 36, an exposure device 38, a developing device 40, and a cleaning device 42. Charging device 36, developing device 40 and cleaning device 42 are arranged around photoreceptor drum 34 in this order. Charging device 36 is arranged vertically above the developing device 40 and cleaning device 42.

Photoreceptor drum 34 is a roller-shaped member supported rotatably about an axial line by a driving unit (not shown). Photoreceptor drum 34 includes, by way of example, a conductive base (not shown) and a photosensitive layer (not shown) formed on the surface of conductive base. On the surface of photosensitive layer, an electrostatic latent image and then toner image are formed. Available conductive base includes a cylinder, a columnar or sheet type base formed of a conductive material such as aluminum or stainless steel. Among these, one having cylindrical shape is preferred. As the photosensitive layer, an organic photosensitive layer or an inorganic photosensitive layer, for example, may be used. A photoreceptor drum including an organic photosensitive layer is referred to as an organic photoreceptor drum, and a photoreceptor drum including an inorganic photosensitive layer is referred to as an inorganic photoreceptor drum. Examples of the organic photosensitive layer includes a laminated photosensitive layer formed, for example, by stacking a charge generating layer formed of resin including charge generating material and a charge transport layer formed of resin including charge transport material, and a single-layer photosensitive layer including both the charge generating material and charge transport material in a single resin layer. The inorganic photosensitive layer includes, by way of example, a single film including one or two selected from the group of zinc oxide, selenium and amorphous silicon. An underlying film is preferably interposed between the conductive base and the photosensitive layer, to make smooth the surface of photosensitive layer by covering scratches and irregularities on the surface of conductive base. Further, a surface film (protective film) is preferably provided on the surface of photosensitive layer, to protect the photosensitive layer and thereby to improve durability.

Charging device 36 is connected to a power source (not shown). Receiving a voltage applied from the power source, charging device 36 charges the surface of photoreceptor drum 34 to a prescribed polarity and potential. In the present embodiment, a saw-tooth charger that performs corona charging on photoreceptor drum 34 is used as charging device 36. The saw-tooth charger is a non-contact type charger provided facing and spaced apart from the surface of photoreceptor drum 34. Though the saw-tooth charger is used as the charging device 36 in the present embodiment, the present invention is not specifically limited thereto and, by way of example, a non-contact type charger or a contact type charger such as a roller type charger, a brush type charger, or a magnetic brush type charger may be used.

Exposure device 38 directs signal light that corresponds to image information of a document read by scanner unit 32 or image information input from an external equipment, to the surface of photoreceptor drum 34 that has been charged to a uniform potential by charging device 36, to form an electrostatic latent image corresponding to the image information on the surface. Exposure device 38 is provided such that the signal light emitted therefrom passes between charging device 36 and developing device 40 to irradiate the surface of photoreceptor drum 34. A laser scanning device including a light source is used as exposure device 38. By way of example, a semiconductor laser, an LED (Light Emitting Diode) array, or an electroluminescence (EL) element may be used as the light source. Examples of the laser scanning device may include a combination of a light source, a polygon mirror, an fθ lens, and a reflection mirror, or a combination of a liquid crystal shutter and a light source.

Developing device 40 supplies toner to the electrostatic latent image on the surface of photoreceptor drum 34 formed by exposure device 38, to form a toner image. Above the developing device 40, a toner cartridge 60 is detachably mounted, for replenishing toner to developing device 40. Structures of developing device 40 and toner cartridge 60 will be described later.

Cleaning device 42 removes toner, paper dust and the like left on the surface of photoreceptor drum 34 after the toner image is transferred to a sheet of recording paper, to clean the surface of photoreceptor drum 34. The toner storage is a container member having an inner space. Cleaning device 42 includes a cleaning blade and a toner storage (both not shown). The cleaning blade is provided to extend parallel to the longitudinal direction of photoreceptor drum 34, with one end in the shorter side direction being in contact with the surface of photoreceptor drum 34. The toner storage temporarily stores and recovers the toner removed by the cleaning blade.

At toner image forming unit 22, exposure device 38 directs signal light in accordance with the image information to the surface of photoreceptor drum 34, which has been uniformly charged by charging device 36, to form an electrostatic latent image. Developing device 40 supplies toner to the electrostatic latent image to form a toner image. The toner image is transferred to a sheet of recording paper by a transfer device 24, which will be described later. Cleaning device 42 removes, after the transfer of toner image, the toner left on the surface of photoreceptor drum 34.

Transfer device 24 is a roller-shaped member rotatably supported by a support member (not shown), and driven to rotate about an axis by a driving unit (not shown). Transfer device 24 is provided to be in pressure-contact with photoreceptor drum 34. Transfer device 24 includes a metal core, and a conductive elastic layer (both not shown) formed on a surface of the metal core. The metal core is a cylindrical or columnar member having the diameter of 8 mm to 10 mm, formed of a metal such as stainless steel or aluminum. The conductive elastic layer is formed of rubber material such as ethylene-propylene rubber (hereinafter denoted as "EPDM"), foamed EPDM or foamed urethane, mixed with conductive material such as carbon black. Transfer device 24 is connected to a power source (not shown). Transfer device 24 receives a voltage (hereinafter referred to as "transfer bias") of a polarity opposite to the toner charging polarity forming the toner image on the surface of photoreceptor drum 34, applied from the power source, and transfers the toner image on the surface of photoreceptor drum 34 to the sheet of recording paper smoothly.

When the sheet of paper supplied from a recording paper supplying unit 28, which will be described later, passes through the pressure-contact portion (hereinafter referred to as the "transfer nip portion") of photoreceptor drum 34 and transfer device 24, transfer device 24 applies the afore-mentioned transfer bias and thereby transfers the toner image carried on the surface of photoreceptor drum 34 to the sheet of recording paper. The sheet of recording paper, on which the toner image has been transferred, is fed to fixing device 26.

Fixing device 26 is provided on the downstream side in the paper feeding direction than transfer device 24. Fixing device 26 includes a fixing roller 44 and a pressurizing roller 46. Fixing roller 44 is a roller-shaped member axially and rotatably supported by a support member (not shown) and driven to rotate about an axis by a driving unit (not shown). Fixing roller 44 includes a metal core and an elastic layer (both not shown). The metal core is a cylindrical member formed of metal such as iron, stainless steel or aluminum. The elastic layer is a single-layer film formed of an elastic material such as silicone rubber or fluoro-rubber, formed on a surface of the metal core. Inside fixing roller 44, a heating member (not shown) is formed. The heating member is connected to a power source (not shown). The heating member receives a voltage applied from the power source, and heats fixing roller 44 such that the surface of fixing roller 44 attains to a prescribed temperature. By way of example, a halogen lamp, an infrared lamp or the like may be used as the heating member. Fixing roller 44 heats and melts the toner forming the toner image carried on the sheet of recording paper fed from the transfer nip portion, so that the toner is fixed on the sheet of recording paper. Pressurizing roller 46 is a roller-shaped member axially and rotatably supported by a support member (not shown), arranged to be in pressure contact with fixing roller 44 by the a pressurizing member (not shown). Pressurizing roller 46 rotates following the rotation of fixing roller 44. A roller having the same structure as fixing roller 44 may be used as pressurizing roller 46. Further, inside pressurizing roller 46, preferably, a heating member (not shown) is provided. A heating member having the same structure as that provided in fixing roller 44 may be used. When the toner is heated and melted by fixing roller 44 and the toner image is fixed on the sheet of recording paper, pressurizing roller 46 presses the toner in the melted state to the sheet of recording paper, to promote fixing of toner image to the sheet of recording paper. In the following, the pressure-contact portion between fixing roller 44 and pressurizing roller 46 will be denoted as fixing nip portion.

When the sheet of recording paper on which the toner image has been transferred in transfer device 24 passes through the fixing nip portion, fixing device 26 heats and melts the toner forming the toner image and presses it to the sheet of recording paper, whereby the toner image is fixed on the sheet of recording paper and the image is formed.

Recording paper supplying unit 28 includes a paper feed cassette 48, a pick-up roller 50, and a first conveyer roller 52. Paper feed cassette 48 is provided vertically below the image forming apparatus 20. Paper feed cassette 48 is a container member storing sheets of recording paper. Recording paper generally includes plain paper, coated paper, color copy paper and a sheet for overhead projector (OHP). Pick-up roller 50 includes a pair of roller members provided to be in pressure-contact with each other. Pick-up roller 50 takes up the sheets of paper stored in paper feed cassette 48 one by one, and feeds the sheet to conveyer roller 52. Conveyer roller 52 includes a pair of roller members provided to be in pressure-contact with each other. Conveyer roller 52 feeds the sheet of recording paper fed from pick-up roller 50 to the transfer nip portion in synchronization with feeding of toner image on the surface of photoreceptor drum 34 to the transfer nip portion by the rotation of photoreceptor drum 34.

Recording paper supplying unit 28 supplies the sheets of recording paper one by one from paper feed cassette 48 to the transfer nip portion, by pick-up roller 50 and conveyer roller 52, in synchronization with feeding of toner image of photoreceptor drum 34 to the transfer nip portion.

Discharging unit 30 includes a second conveyer roller 54 and a discharge roller 56, and a discharge tray 58. Conveyer roller 54 includes a pair of roller members provided to be in pressure contact with each other. Conveyer roller 54 is provided on the downstream side in the paper feeding direction P than the fixing nip portion. Conveyer roller 54 feeds the sheet of recording paper, on which an image has been formed by fixing device 26, to discharge roller 56. Discharge roller 56 includes a pair of roller members provided to be in pressure contact with each other. Discharge roller 56 discharges the sheet of recording paper, fed from conveyer roller 54, to discharge tray 58 provided vertically above image forming apparatus 20. Discharge tray 58 is a member for storing the sheet of recording paper on which an image has been formed.

Discharging unit 30 discharges the sheet of recording paper, on which the image has been formed by fixing device 26, to discharge tray 58 to be stored thereon, by conveyer roller 54 and discharge roller 56.

Scanner unit 32 includes a document set tray, a reversing automatic document feeder (hereinafter denoted as "RADF"), and a document reading device (all not shown). RADF feeds a document placed on the document set tray to a platen of the document reading device, which will be described later. The document reading device includes the platen, a document scanning device, a reflecting member, and a photo-electric converting element (Charge Coupled Device, hereinafter denoted as "CCD") line sensor (all not shown). The platen is a plate member formed of glass, having an upper surface serving as a document placing surface for placing the document. The platen has a cover member supported to open/close the document placing surface, and on the cover member, the document set tray and RADF are provided. The document to be placed on the platen is manually placed by the user, or placed by RADF. The document scanning device is provided to reciprocate at a constant scanning speed V, in parallel with and keeping a constant distance to the lower surface of the platen. The document scanning device includes a light source and a first reflection mirror (both not shown). The light source directs light to the surface of the image of the document, placed on the platen. The first reflection mirror reflects reflected light image from the document to the reflecting member. Specifically, the document scanning device reciprocates at a constant scanning speed V in parallel with and along the lower surface of the platen while irradiating the surface of the image of the document having the image placed on the platen with light, and reflects the thus generated reflected light image to the reflecting member. The reflecting member is provided to reciprocate in parallel with the document scanning device while keeping a prescribed speed relation with the document scanning device, that is, at a speed of V/2. The reflecting member includes a second reflection mirror, a third reflection mirror, and an optical lens (all not shown). The second and third reflection mirrors reflect the reflected light image from the document, reflected by the first reflection mirror of the document scanning device, further to the optical lens. The optical lens reduces the reflected optical image reflected by the second and third reflection mirrors, and forms a reflected optical image reduced in size on a prescribed position on CCD line sensor. Specifically, the reflecting member reciprocates at the speed of V/2 following the reciprocating movement of the document scanning device, and forms the reflected optical image reflected by the document scanning device on a prescribed position on the CCD line sensor. The CCD line sensor includes a CCD circuit that performs photo-electric conversion of the reflected optical image formed by the optical lens, to an electric signal. The CCD line sensor reads the document image, successively performs photo-electric conversion of the read image information, and outputs the result as electric signals to a control unit of image forming apparatus 20.

Scanner unit 32 reads the image information of every prescribed number of lines, for example, every ten lines, from the document placed on the platen, converts the read image information to electric signals, and outputs the signals to the control unit of image forming apparatus 20.

The control unit is provided, for example, at an upper portion of image forming apparatus 20. The control unit includes a processing circuit implemented by a microprocessor or a microcomputer including a CPU (Central Processing Unit), a storage unit including an ROM (Read Only Memory), an RAM (Random Access Memory) and an HDD (Hard Disk Drive), and a main power source (all not shown). The storage unit stores various setting values input from an operation panel (not shown) provided on an upper surface of image forming apparatus 20, results of detection by various sensors (not shown) arranged at various portions in image forming apparatus 20, image information input from external equipment, image information input from scanner unit 32, and various programs for executing various processes including a print job. As the external equipment, electric/electronic devices that can be electrically connected to image forming apparatus 20 and capable of forming or obtaining image information may be used. The external equipment may include, for example, a personal computer, a digital camera, a television receiver, a video recorder, a DVD (Digital Versatile Disc) recorder, an HDDVD (registered trademark: High-Definition Digital Versatile Disc), a blue-ray disk recorder, a facsimile machine and a portable terminal. The processing circuit reads various programs or various data such as image information or result of detection stored in the storage unit, makes various determinations, and transmits control signals to corresponding components in image forming apparatus 20 in accordance with the result of determination, to control operations of various components. By way of example, the processing circuit converts image information input from scanner unit 32 or external equipment to a corresponding control signal, and outputs it to exposure device 38. The processing circuit determines whether toner should be replenished or not, depending on a result of detection by a toner density detecting sensor 70, which will be described later. If replenishment is necessary, control signals are transmitted to driving units driving and rotating toner discharging member 82 and toner stirring member 84, respectively, of toner cartridge 60 as will be described later, so that toner discharging member 82 and toner stirring member 84 are driven to rotate. The main power source supplies electric power not only to the control unit but also to various components in image forming apparatus 20.

[Developing Device 40]

Figure 3:
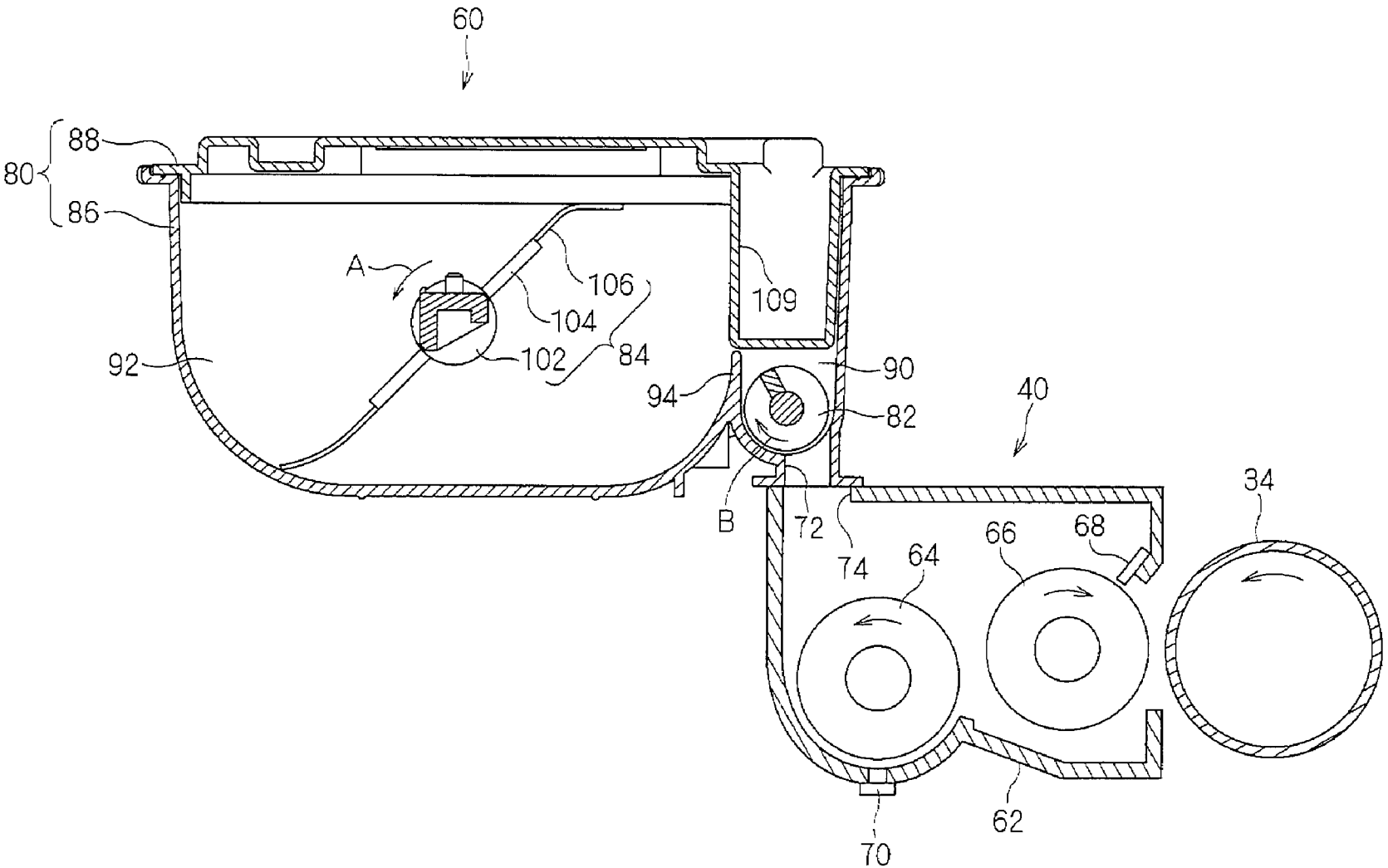
FIG. 3 is a cross-sectional view schematically showing a structure of developing device and toner cartridge in accordance with an embodiment of the present invention.
Figure 4:
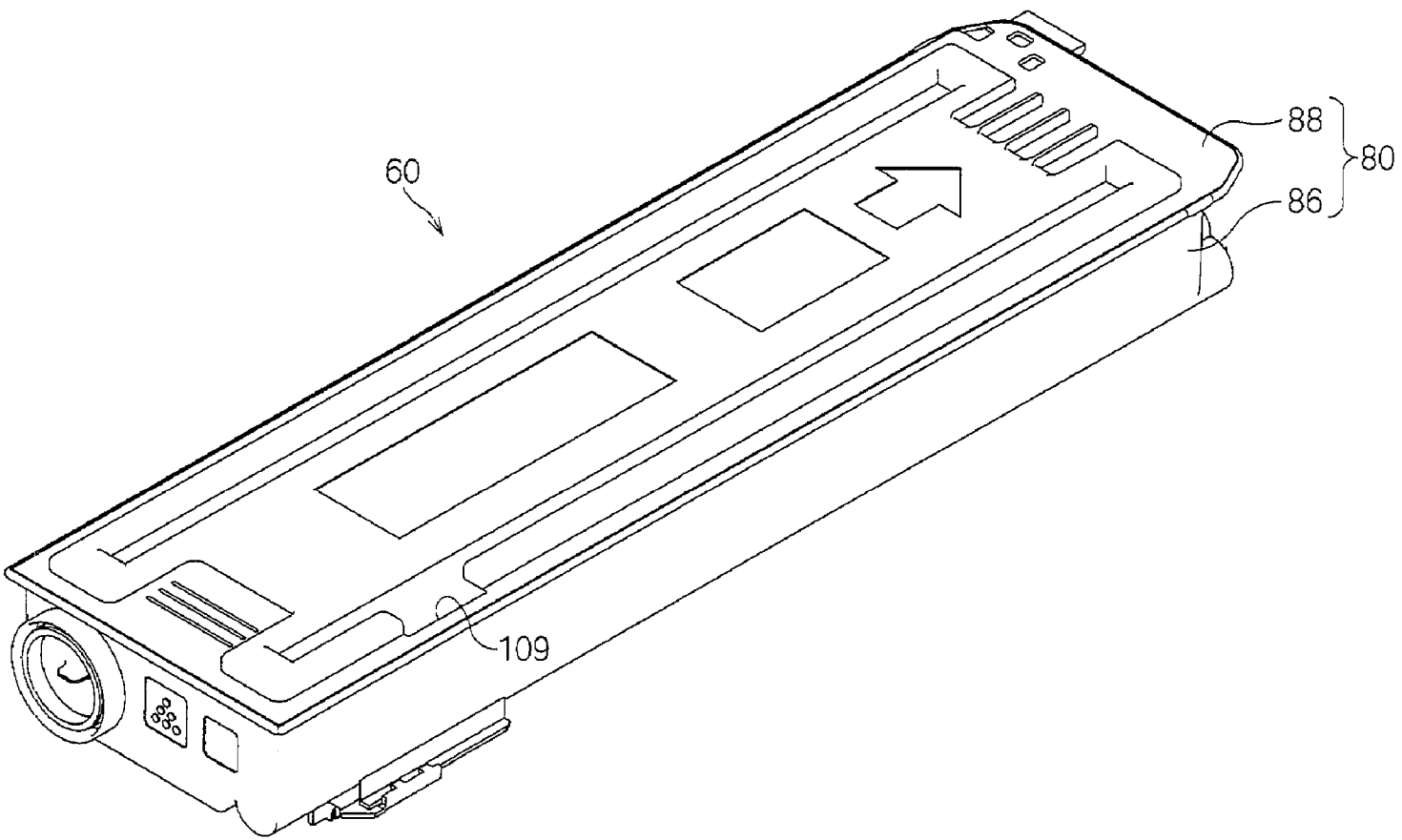
FIG. 4 is a perspective view of the toner cartridge in accordance with an embodiment of the present invention.
Figure 5:
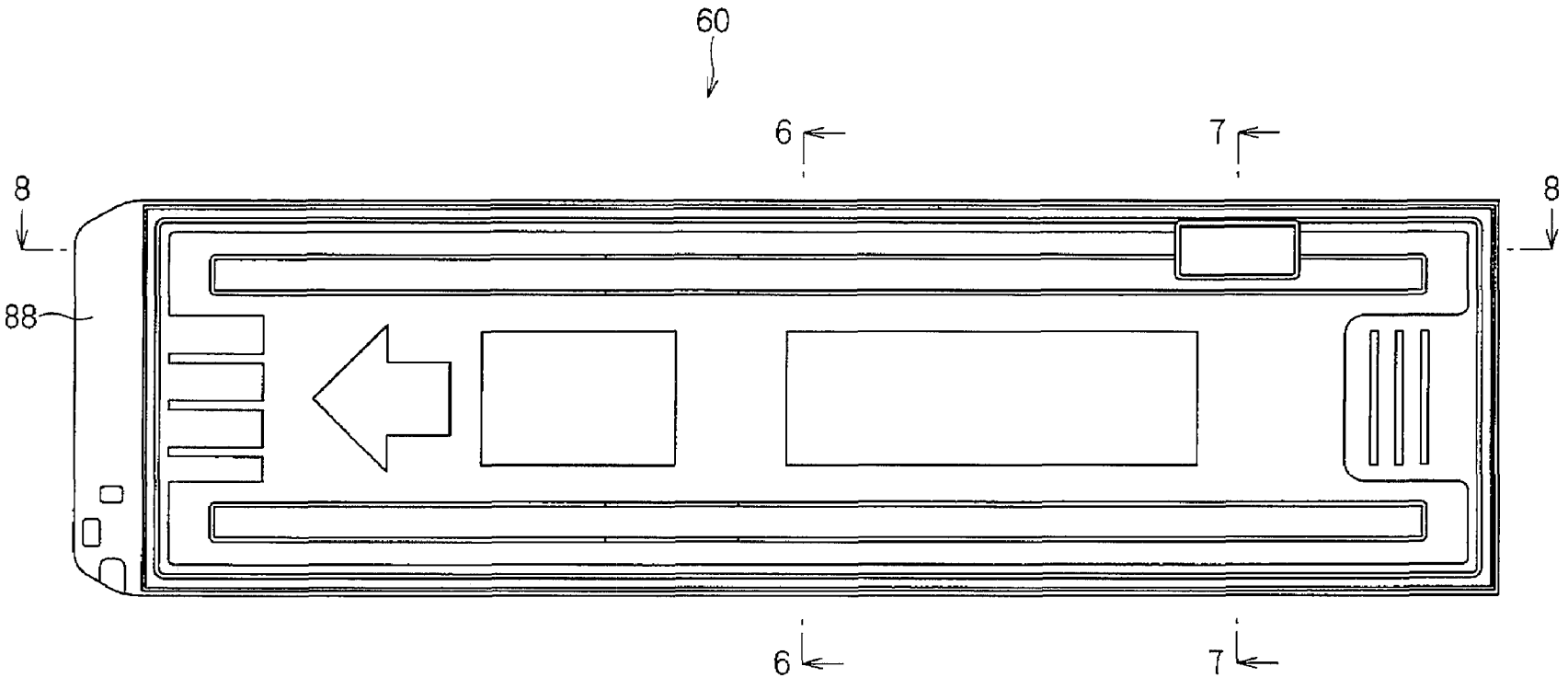
FIG. 5 is a plan view showing the toner cartridge of the embodiment from above.
Figure 6:
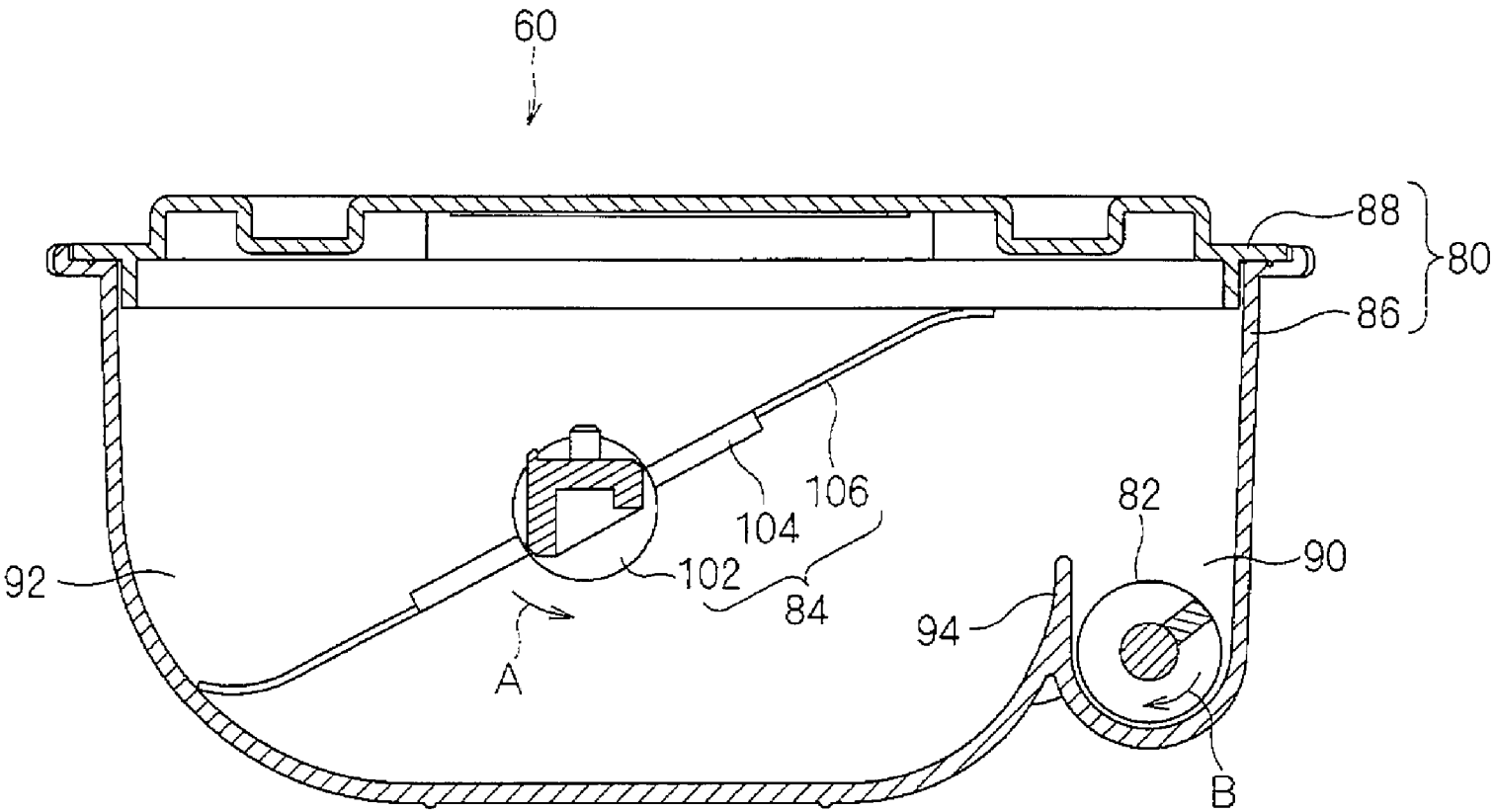
FIG. 6 is a cross-sectional view of the toner cartridge shown in FIG. 5, taken along the line 6-6.
Figure 7:
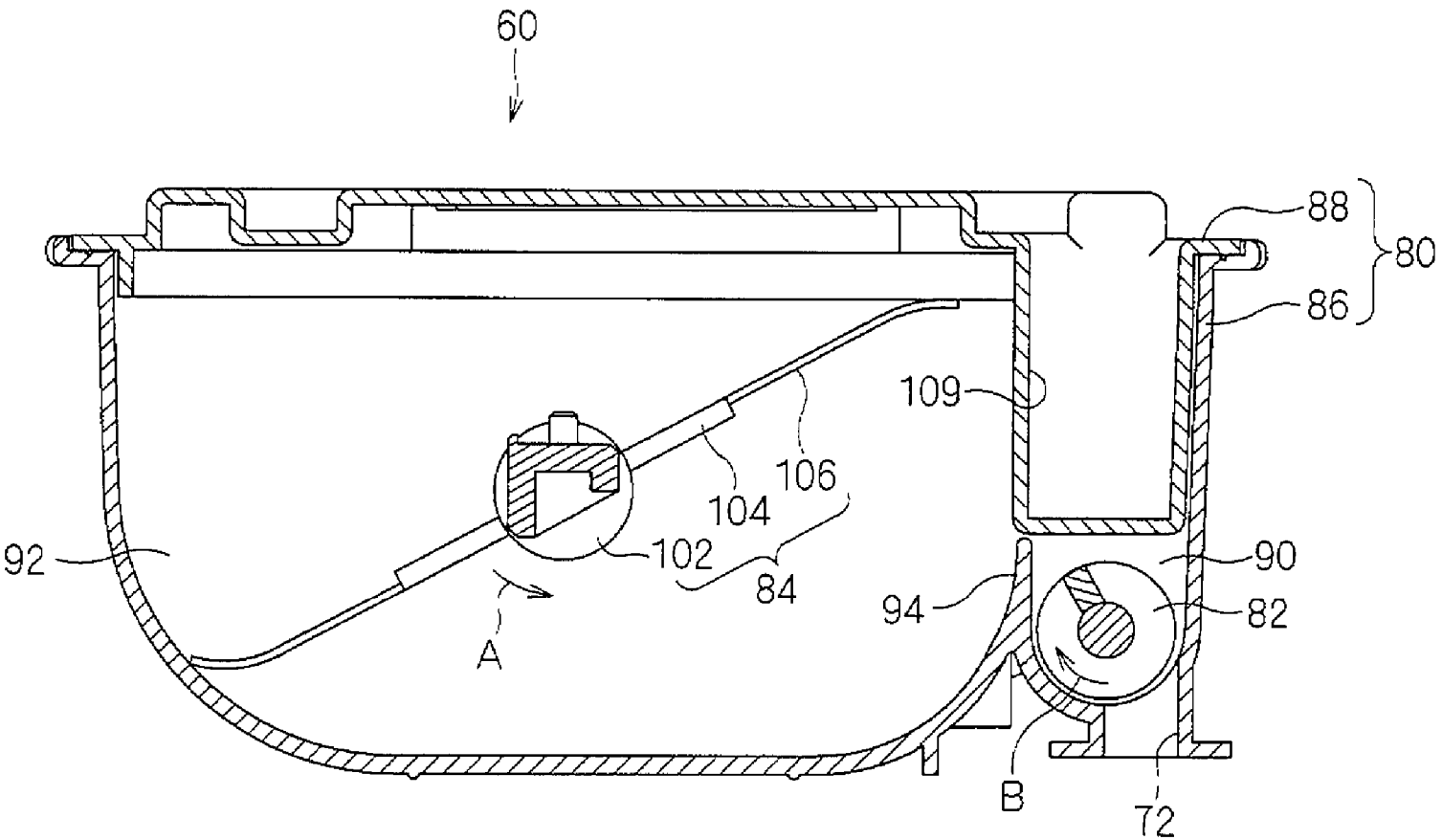
FIG. 7 is a cross-sectional view of the toner cartridge shown in FIG. 5, taken along the line 7-7.
Figure 8:
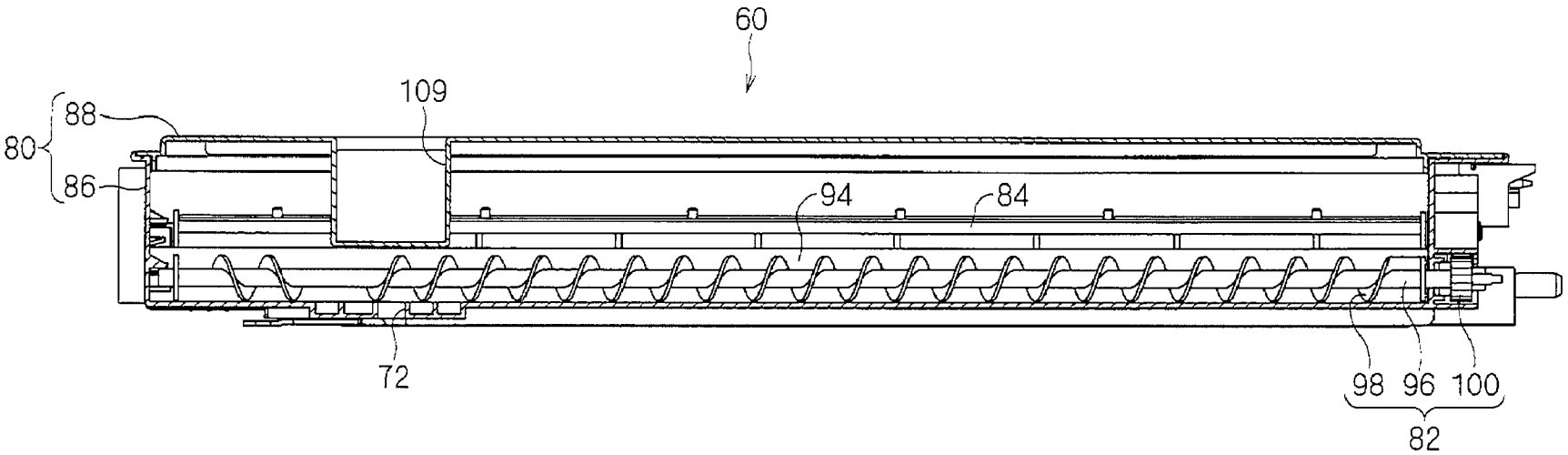
FIG. 8 is a cross-sectional view of the toner cartridge shown in FIG. 5, taken along the line 8-8.
Figure 9:
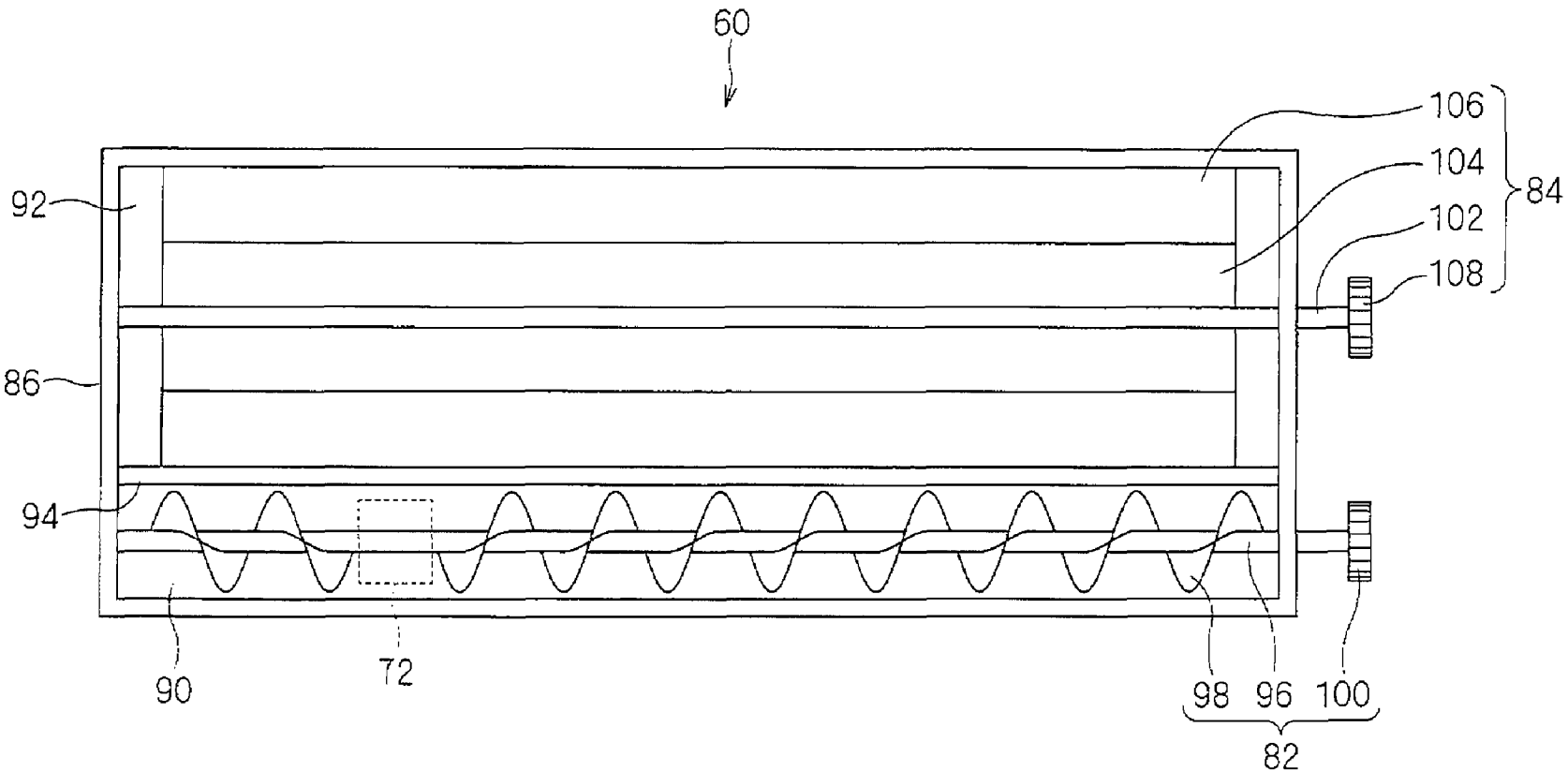
FIG. 9 is a plan view of the toner cartridge with upper lid removed, viewed from above.

Referring to FIG. 3, developing device 40 includes a developer tank 62, a stirring roller 64, a developing roller 66, a regulating member 68, and a toner density detecting sensor 70.

Developer tank 62 is a container member formed to have a substantially semi-cylindrical shape, having an inner space. Developer tank 62 is arranged facing the surface of photoreceptor drum 34. On that side surface of developer tank 62 which faces photoreceptor drum 34 has an opening, and at a position opposite to photoreceptor drum 34 through the opening, developing roller 66 is provided. Developer tank 62 contains two-component developer including toner and carrier, in the inner space thereof. Further, developer tank 62 contains stirring roller 64 and developing roller 66 as roller-shaped members, and axially supports these in a rotatable manner. Vertically above developer tank 62, a toner receiving inlet 74 is provided, to be communicated with a toner outlet 72 provided at a vertically lower portion of toner cartridge 60. In accordance with the state of toner consumption in developer tank 62, toner is replenished from toner cartridge 60 through inlet 74.

Stirring roller 64 is a roller-shaped member axially supported to be driven and rotate about an axis by a driving unit (not shown). Stirring roller 64 is provided to face developing roller 66. Stirring roller 64 stirs the two-component developer contained in developer tank 62, and supplies it to the periphery of developing roller 66.

Developing roller 66 is a roller-shaped member axially supported to be driven and rotate about an axis by a driving unit (not shown). Developing roller 66 is provided opposite to the photoreceptor drum 34 with a space therebetween through the opening of developer tank 62. Developing roller 66 is connected to a power source (not shown). From the power source, a potential of opposite polarity to the toner charging potential is applied as developing bias voltage (hereinafter referred to as "developing bias") to the surface of developing roller 66, whereby the toner on the surface of developing roller 66 is supplied smooth to the electrostatic latent image on the surface of photoreceptor drum 34. The two-component developer carried by the rotation of developing roller 66 is brought into contact with photoreceptor drum 34 at the closest portion to photoreceptor drum 34 (hereinafter referred to as the "development nip portion"). At the development nip portion, when the developing bias is applied to the surface of developing roller 66, toner is supplied from the two-component developer on the surface of developing roller 66 to the electrostatic latent image on the surface of photoreceptor drum 34. By changing the value of developing bias, it is possible to adjust the amount of toner (amount of toner adhesion) supplied to the electrostatic latent image.

Regulating member 68 is a plate-shaped member provided to extend parallel to the axial direction of developing roller 66, vertically above developing roller 66. One end in the shorter side direction of regulating member 68 is supported by developer tank 62, and the other end in the shorter side direction is arranged spaced apart from and opposite to the surface of developing roller 66. Regulating member 68 is formed of stainless steel, aluminum, synthetic resin or the like. Regulating member 68 regulates thickness of the layer of two-component developer carried on the surface of developing roller 66.

Sensor 70 is mounted on a wall of developing tank vertically below stirring roller 64, that is, on a bottom surface of developer tank 62, such that its sensing surface is exposed to the inner space of developer tank 62. Sensor 70 is electrically connected to a control unit provided inside image forming apparatus 20. A common sensor may be used as sensor 70. By way of example, sensor 70 may be a transmitted light detection sensor, a reflected light detection sensor, or a magnetic permeability detection sensor. Of these, a magnetic permeability detection sensor, which outputs, upon reception of a control voltage, a detection result of toner density as an output voltage value, is preferred. A magnetic permeability detection sensor of this type is commercially available. Examples of magnetic permeability detection sensor include TS-L, LS-A and TS-K (all trade names, manufactured by TDK Corporation). Sensor 70 is connected to a power source (not shown). The power source applies a driving voltage for driving sensor 70 and a control voltage for outputting the detection result of toner density to the control unit of image forming apparatus 20, to sensor 70. Application of voltage from the power source to sensor 70 is controlled by the control unit of image forming apparatus 20. If a magnetic permeability sensor is used as sensor 70, basically, sensitivity near the central value of output voltage is high and, therefore, it is preferable to use the sensor while applying the control voltage attaining output voltage around such a value.

[Toner Cartridge 60]

FIGS. 4 to 9 show a structure of toner cartridge 60.

Referring to FIGS. 3 to 9, toner cartridge 60 includes a toner holding container 80, toner discharging member 82, and toner stirring member 84. Toner holding container 80 is a container member formed to have a substantially semi-cylindrical shape having an inner space for holding toner. Toner holding container 80 is formed of a container 86 and an upper lid 88. Container 86 is a container member with a bottom and an upper opening. On the bottom portion of container 86, at the central portion in the longitudinal direction, a toner outlet 72 is formed, which is an opening having a substantially rectangular shape. Outlet 72 is formed at at position communicable to receiving inlet 74 provided at an upper portion of developer tank 62, when toner cartridge 60 is mounted on developing device 40. In accordance with the state of toner consumption in developer tank 62, toner is replenished from toner cartridge 60 to developer tank 62, through outlet 72. At the bottom of container 86, a partition wall 94 is provided. Partition wall 94 separates the inner space of container 86 to a toner discharging portion 90 in which outlet 72 is formed, and a toner stirring portion 92 other than the toner discharging portion 90. Partition wall 94 is a plate-shaped member extending along the longitudinal direction of container 86, and formed to leave a space from upper lid 88. Specifically, between partition wall 94 and upper lid 88, toner discharging portion 90 and toner stirring portion 92 are communicated.

Inside toner discharging portion 90 above outlet 72, toner discharging member 82 is placed. Toner discharging member 82 has a first rotation shaft 96, a toner carrying unit 98, and a first rotation gear 100. Rotation shaft 96 is a columnar member of which axis extends along the longitudinal direction of container 86. Opposite ends of rotation shaft 96 are rotatably supported by container 86.

Toner carrying unit 98 is a blade member formed spirally around rotation shaft 96. Toner carrying unit 98 is implemented, for example, by a screw auger, a spiral coil or the like. The spiral of toner carrying unit 98 is inclined in such a direction that the toner is carried from axially opposite ends of toner discharging member 82 toward the outlet 72. Specifically, the spiral is set to be inclined in opposite directions, with a position corresponding to outlet 72 being the center. The interval, radius and the like of the spiral of toner carrying unit 98 may be appropriately set such that the toner carrying speed attains to a desired speed, considering the speed of rotation of toner discharging member 82 and the like.

Gear 100 is a gear member formed at one end of rotation shaft 96. Gear 100 is connected to a motor (not shown), as a driving source. Gear 100 transmits the driving force from the driving source to rotation shaft 96, and rotates rotation shaft 96. It is noted that the motor is connected to the control unit of image forming apparatus 20. The control unit controls the rotating operation of rotation shaft 96.

Toner discharging member 82 rotates about rotation shaft 96, by the driving force from a driving source, not shown, transmitted through gear 100. By the rotation, toner discharging member 82 carries the toner contained in toner discharging portion 90 of container 86 to outlet 72 from opposite ends in the axial direction of toner discharging member 82, so that the toner is supplied to developer tank 62 of developing device 40 through outlet 72.

In toner stirring portion 92, toner stirring member 84 is placed. Toner stirring member 84 includes a second rotation shaft 102, a toner stirring plate 104, a toner take-up blade 106, and a second rotation gear 108. Rotation shaft 102 is a columnar member having its axis extending along the longitudinal direction of container 86. Opposite ends of rotation shaft 102 are rotatably supported by container 86.

Toner stirring plate 104 is a plate-shaped member extending in two directions with rotation shaft 102 being the center, and extending parallel to the axis of rotation shaft 102. Blade 106 is a sheet-shaped member of which length in the longitudinal direction is made substantially equal to the length in the longitudinal direction of toner stirring plate 104. Blade 106 is formed at opposite ends in the shorter side direction of toner stirring plate 104, to be in contact with an inner wall of toner holding container 80. Preferably, blade 106 has a thickness of 0.5 mm to 2.0 mm. The material forming blade 106 is not specifically limited, provided that it is flexible. Preferable material is resin, such as polyethylene terephthalate (PET). Blade 106 formed of such a material to have such a thickness allows easier deformation of blade 106. As a result, when blade 106 deforms and slides over the inner wall of toner holding container 80, it can more smoothly take-up the toner and carry the toner to toner discharging portion 90.

Gear 108 is a gear member provided at one end of rotation shaft 102. Gear 108 is connected to a motor as a driving source (not shown). Gear 108 transmits the driving force from the driving source to rotation shaft 102 and rotates rotation shaft 102. It is noted that the motor is connected to the control unit of image forming apparatus 20. The control unit controls the rotation operation of rotation shaft 102.

Toner stirring member 84 rotates about rotation shaft 102, and thereby stirs the toner contained in toner stirring portion 92 of container 86. Further, blade 106 deforms and slides over the inner wall of toner holding container 80, whereby it takes up the toner contained in toner stirring portion 92 of container 86 and carries the toner to toner discharging portion 90.

As described above, the inner space of container 86 is separated in the horizontal direction into toner discharging portion 90 and toner stirring portion 92 by partition wall 94, so that toner discharging member 82 does not much receive the weight (gravity) of toner contained in the toner stirring portion 92. Therefore, the stress imposed on the toner by friction with toner discharging member 82 can be reduced, and degradation of toner characteristics can be prevented.

In order to attain high efficiency of carrying the toner by toner stirring member 84 and toner discharging member 82, preferably, the height of partition wall 94 provided between toner stirring member 84 and toner discharging member 82 is made higher than the vertical upper end portion of toner discharging member 82, when toner cartridge 60 is mounted on image forming apparatus 20. By making the height of partition wall 94 higher than the vertical upper end portion of toner discharging member 82, it is becomes possible to prevent the carried toner from being returned from the toner discharging portion 90 to toner stirring portion 92. As a result, an appropriate amount of toner can be held around the toner discharging member 82, and the toner can be carried in a stable and efficient manner by toner stirring member 84 and toner discharging member 82. Further, entrance of air to the toner around outlet 72 becomes less likely and, therefore, accidental leakage of toner from outlet 72 can more effectively be prevented. If the height of partition wall 94 is lower than the vertical upper end portion of toner discharging member 82, it becomes impossible to hold an appropriate amount of toner around toner discharging member 82 and, therefore, air tends to be mixed to the toner around outlet 72.

Upper lid 88 of toner holding container 80 is a plate-shaped member formed to close the upper opening of container 86. At that portion of upper lid 88 which corresponds to outlet 72 formed at the bottom of container 86, a recess 109 is formed, deep to the side of container 86. In the present embodiment, the bottom of recess 109 has a rectangular shape, and it is formed to be in contact with an upper end of partition wall 94. Therefore, partition wall 94, recess 109 of upper lid 88 and inner wall of container 86 come to surround toner discharging member 82 positioned close to and above the outlet 72, like a tunnel. Toner discharging member 82 is preferably provided not to be in contact with partition wall 94, recess 109 of upper lid 88 and the inner wall of container 86, and to have a distance of about 1 mm from each of these. Such an arrangement allows smooth rotation of toner discharging member 82, and further, enables further reduction in size of toner cartridge 60.

Figure 10:
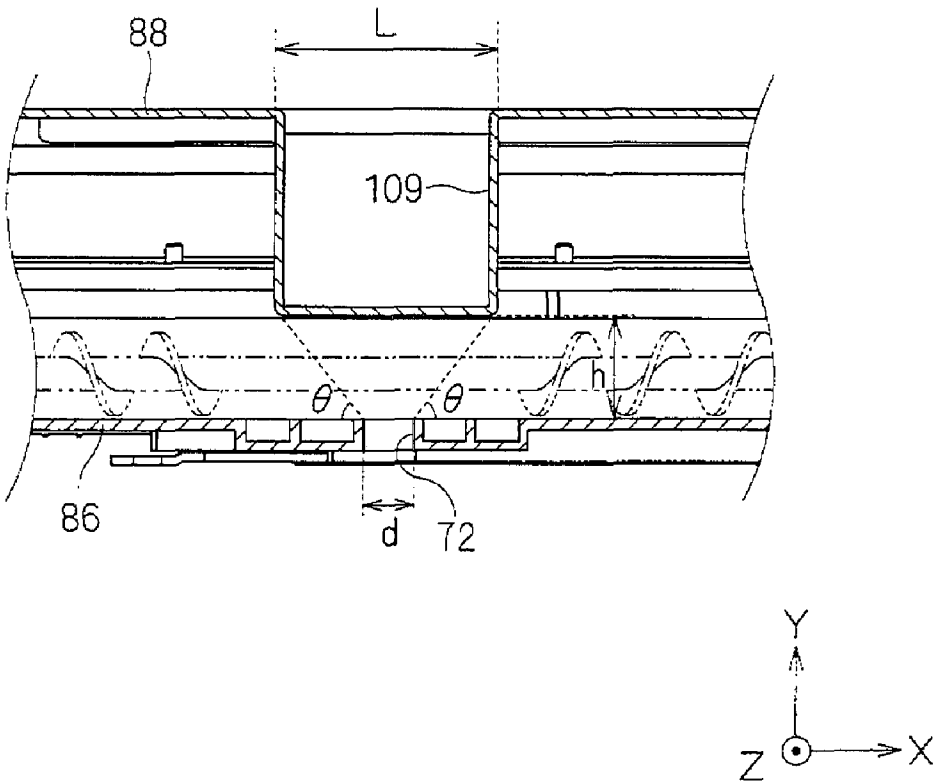
FIG. 10 is a cross-sectional view showing the recessed portion of upper lid and the toner outlet portion.

In the present specification, in the following, the longitudinal direction (the left/right direction in FIG. 10) of toner cartridge 60 will be referred to as the X-direction, the height direction (up/down direction in FIG. 10) will be referred to as the Y-direction, and a direction orthogonal to the longitudinal and height directions (vertical direction to the sheet of FIG. 10) will be referred to as the Z-direction. Referring to FIG. 10, recess 109 is formed such that a bottom corner of recess 109 has a right angle, on a phantom plane parallel to the X- and Y-directions.

The size of recess 109 of upper lid 88 and the size of outlet 72 are set in the following manner. Specifically, the center of a plane projected in the X-direction of outlet 72 on the bottom of recess 109 (hereinafter referred to as "projected plane of the outlet") is the same as the center of the bottom of recess 109, and the projected plane of the outlet is set to be encompassed by the bottom of recess 109. Here, it is preferred that the area of bottom surface of recess 109 is set to be three to four times the area of projected plane of the outlet. Further, on a phantom plane parallel to the X- and Y-directions of FIG. 10, assume that a line connecting one end of opening of outlet 72 to one end of the bottom of recess 109 positioned closest to said one end and the bottom surface of container 86 form an angle $\theta$ (hereinafter referred to as an "inclination angle"). Preferably, the dimension of the bottom portion of recess 109 is selected such that the inclination angle $\theta$ becomes smaller than the angle of repose of the toner. Specifically, when we represent the dimension in axial direction of toner discharging member 82 at the opening of outlet 72 by d, the angle of repose of toner by $\alpha$, and the distance between the bottom of recess 109 and the bottom of container 86 by h, it is preferred that the width L in the axial direction of the bottom of recess 109 should be equal to or larger than $d+2h \cos \alpha$. Further, if the width L is made too large, load would be imposed on the toner at this portion. Therefore, it is desirable to set the upper limit of width L to about $2d+2h \cos \alpha$. Further, the distances d and h and the angle $\theta$ are set such that the area of the bottom of recess 109 is made three to four times the area of the projected plane of the outlet.

In the present specification, the angle of repose represents an angle measured by using a powder tester (trade name: P-100, manufactured by Hosokawa Micron). As to the specific method of measuring the angle of repose, 100 g of toner sifted through a mesh having the opening of 502 μm is deposited on a round table having the diameter of 8 cm, and the angle formed by the surface of round table and the ridge line of toner deposited on the round table is measured by using laser beam.

As the sizes of recess 109 and outlet 72 are set in this manner, the amount of air entering from above outlet 72 can further be reduced. As a result, accidental leakage of toner from outlet 72 can more effectively be prevented.

(Operation)

Image forming apparatus 20 in accordance with the present embodiment operates in the following manner. For instance, when a user places a document on the platen of scanner unit 32 and instructs start of a print job by the copying function by an input operation through the operation panel, first, scanner unit 32 reads image information of every few lines, for example, every ten lines, from the document placed on the platen. Then, the read image information is converted to an electric signal, and output to the control unit of image forming apparatus 20. The electric signal input to the control unit is converted to a corresponding control signal by the processing circuit, and output to exposure device 38.

At toner image forming unit 22, by exposure device 38, signal light corresponding to the control signal input from the control unit is directed to the surface of photoreceptor drum 34 that has been uniformly charged by charging device 36, and an electrostatic latent image is formed. Thereafter, developing device 40 supplies toner to the formed electrostatic latent image, whereby a toner image is formed.

At this time, toner density in developer tank 62 is measured by a sensor 70 of developing device 40, and the measured result of detection is output to the control unit of image forming apparatus 20. The processing circuit of control unit determines whether the toner should be replenished or not, depending on the result of detection input from sensor 70.

If it is determined by the processing circuit that the toner density has lowered and toner replenishment is necessary, control signals are transmitted to motors serving as driving units for driving and rotating toner discharging member 82 and toner stirring member 84 of toner cartridge 60, so that the toner discharging member 82 and toner stirring member 84 are driven and rotated. By the rotation of toner stirring member 84 in the direction of arrow A (FIGS. 3, 6 and 7), the toner contained in toner stirring portion 92 of container 86 is stirred, and blade 106 deforms and slides over the inner wall of toner holding container 80 to take up the toner contained in toner stirring portion 92 of container 86 and carries the toner to toner discharging portion 90. Further, by the rotation of toner discharging member 82 in the direction of arrow B (FIGS. 3, 6 and 7), the toner carried to the inside of toner discharging portion 90 of container 86 is carries from opposite ends in the axial direction of toner discharging member 82 to the outlet 72, and supplied from outlet 72 to the developer tank 62 of developing device 40.

If it is determined by the processing circuit that toner replenishment is unnecessary, no control signal is transmitted, and hence, rotations of toner discharging member 82 and toner stirring member 84 of toner cartridge 60 are kept stopped.

The toner image formed on the surface of photoreceptor drum 34 by developing device 40 is transferred to a sheet of recording paper fed by recording paper supplying unit 28, by transfer device 24. The toner left on the surface of photoreceptor drum 34 after the transfer of toner image is removed by cleaning device 42. The sheet of recording paper on which the toner image has been transferred is fed to fixing device 26, and by fixing device 26, the toner forming the toner image is heated and melted, and pressed to the sheet of recording paper. Consequently, the toner image is fixed on the sheet of recording paper, and a monochrome or single color image is formed. The sheet of recording paper on which the image has been formed is discharged by discharging unit 30 to discharge tray 58 and stored therein.

Here, the state of a conventional toner cartridge 110 and the state of toner cartridge 60 in accordance with the present embodiment, when toner replenishment is determined to be unnecessary by the processing circuit of control unit, will be described.

Figure 11:
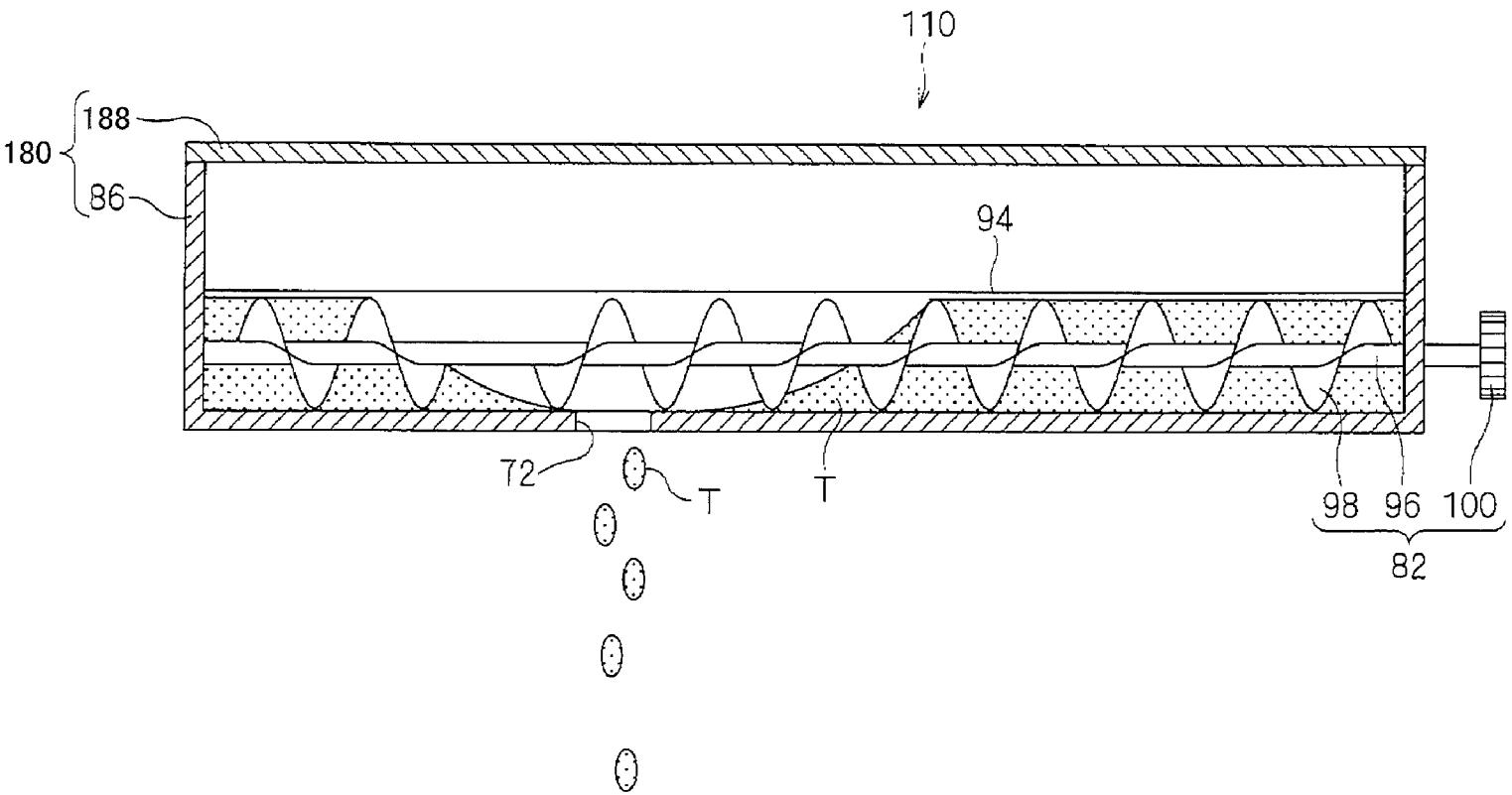
FIG. 11 is a cross-sectional view schematically showing the state of conventional toner cartridge, when rotations of the toner discharging member and the toner stirring member are stopped.

Referring to FIG. 11, in conventional toner cartridge 110, recess 109 is not formed at that portion of upper lid 188 of toner holding container 180 which is opposite to the outlet 72. As a result, if there is an impact or vibration while rotations of toner discharging member 82 and toner stirring member 84 are stopped, air tends to enter from above the outlet 72 and tends to be mixed with toner T around outlet 72. The toner T mixed with air turns to aerosol, which may possibly leak accidentally from outlet 72.

Figure 12:
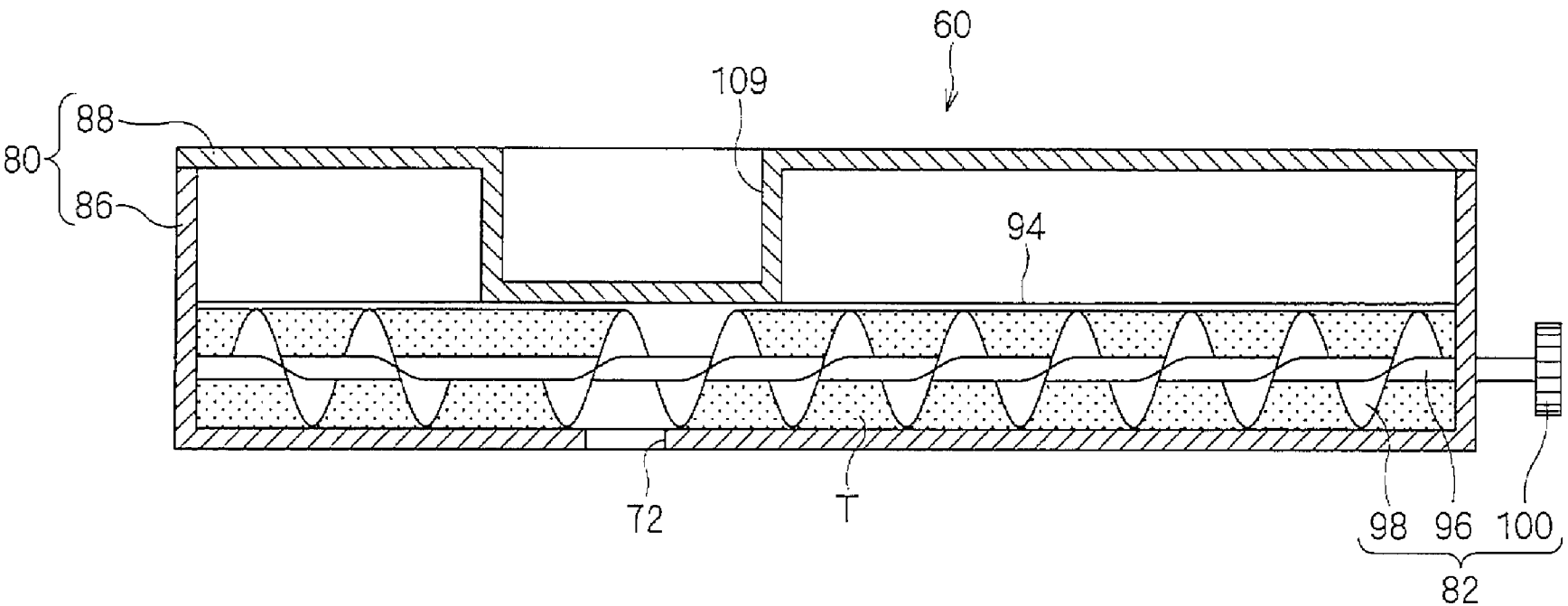
FIG. 12 is a cross-sectional view schematically showing the state of toner cartridge in accordance with an embodiment of the present invention, when rotations of the toner discharging member and the toner stirring member are stopped.

On the contrary, referring to FIG. 12, in toner cartridge 60 in accordance with the present embodiment, recess 109 is formed at that portion of upper lid 88 of toner holding container 80 which is opposite to the outlet 72. Therefore, partition wall 94, recess 109 of upper lid 88 and inner wall of container 86 surround toner discharging member 82 above outlet 72, like a tunnel. As a result, even if there is an impact or vibration while rotations of toner discharging member 82 and toner stirring member 84 are stopped, air hardly enters from above the outlet 72 to the toner T around outlet 72, and adhesion of toner is maintained, so that toner T is not turned to aerosol. Therefore, accidental leakage of toner T from outlet 72 can be prevented. Therefore, the amount of toner T to be supplied to developing device 40 can accurately be controlled.

In the arrangement above, an instruction to start a print job by copying function is given by an input operation by the user through the operation panel. When an instruction to start a print job by facsimile function is given, scanner unit 32 does not operate, and an image is formed on the sheet of recording paper through operations similar to those described above in accordance with the image information input from an external equipment.

[Modification]

Figure 13:
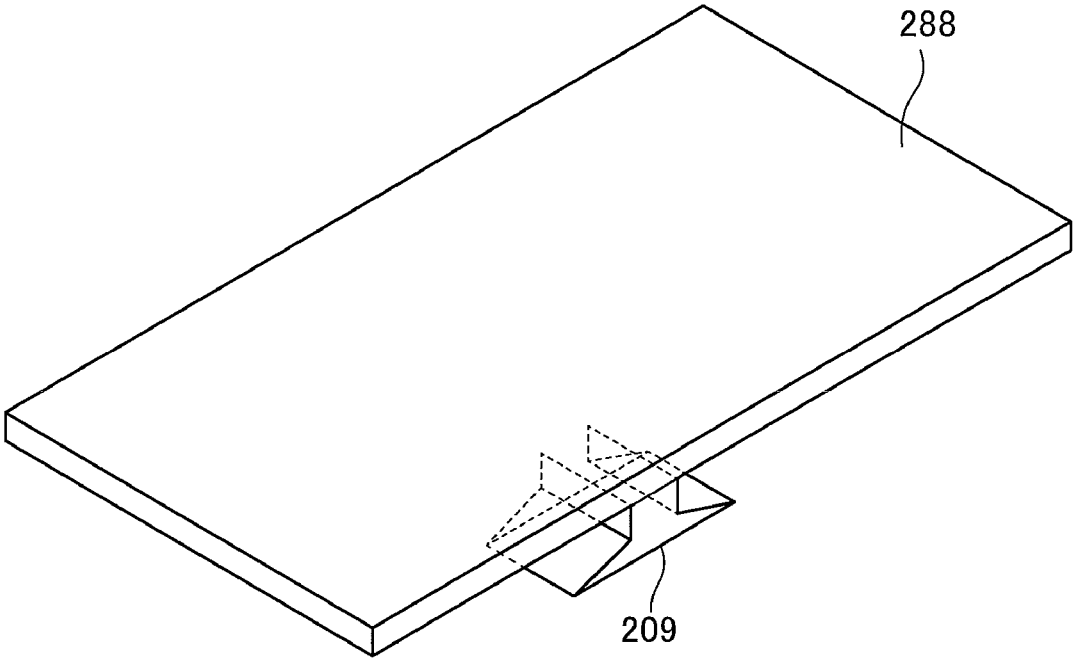
FIG. 13 is a perspective view schematically showing the shape of recessed portion formed in the upper lid of toner holding container.
Figure 14:
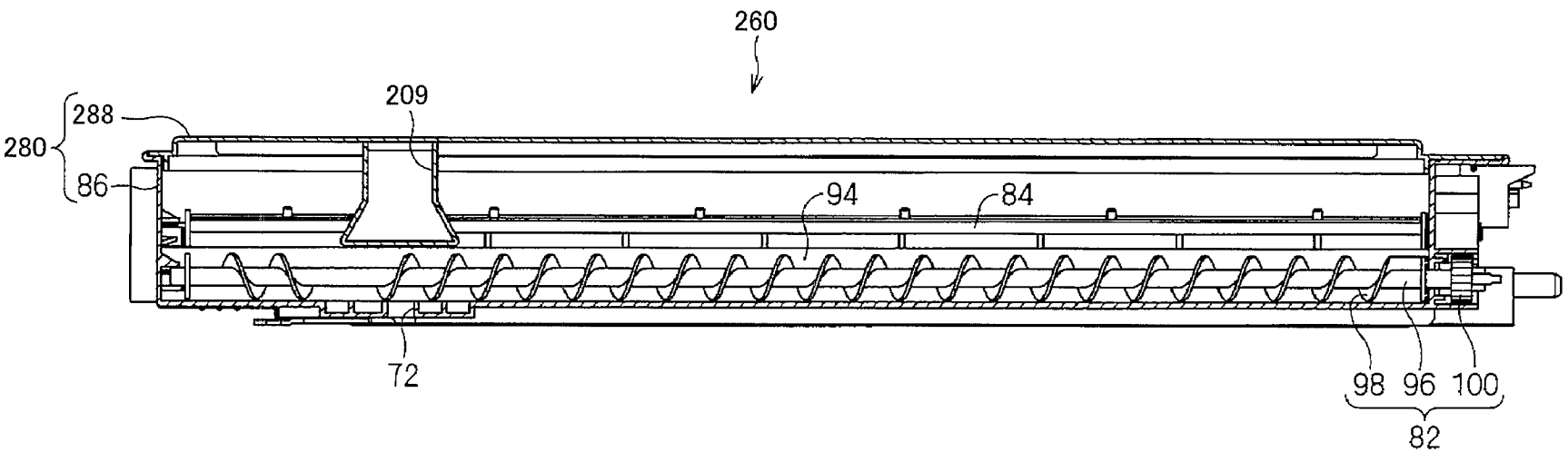
FIG. 14 is a cross-sectional view of the toner cartridge cut along a plane, including the recessed portion, parallel to the longitudinal and height directions.

FIGS. 13 and 14 show a modification of a recess 209 in toner cartridge 260. Referring to FIG. 13, recess 209 in accordance with the modification is formed not by the upper lid 288 deformed deep to the side of container 86 but by attaching a plate-shaped member deformed to have a bottom portion of the size defined above, to upper lid 288. Referring to FIG. 14, recess 209 is formed such that the bottom corner of recess 209 has an acute angle, on a phantom plane parallel to the X- and Y-directions. Specifically, recess 209 is formed extending from the upper portion to the bottom portion in the vertical direction, such that the width in axial direction is kept constant to the middle portion in the vertical direction and gradually increased from the middle portion.

By forming recess 209 to have a bottom of the size defined as described above, the amount of air entering from above outlet 72 can be reduced. As a result, accidental leakage of toner from outlet 72 can more effectively be prevented. Further, by adjusting the shape of bottom corner of recess 209, the amount of toner carried by toner discharging member 82 to outlet 72 can be controlled. Therefore, even when the amount of toner is large, the amount of toner supply can be made stable. By way of example, if the bottom corner of recess 209 has a right angle, the amount of toner supply increases, and if it has an acute angle, the amount of toner supply decreases.

(Functions/Effects)

According to the present embodiment, toner cartridge 60 or 260 includes: a toner holding container 80 containing toner therein and having outlet 72 formed to discharge the contained toner; a partition wall 94 separating the inside of toner holding container 80 to a toner discharging portion 90 in which outlet 72 is formed, and a toner stirring portion 92 other than the toner discharging portion 90; toner discharging member 82 axially supported in toner discharging portion 90 to be rotatable about rotation shaft 96, and carrying the toner contained in toner discharging portion 90 to outlet 72; toner stirring member 84 axially supported in toner stirring portion 92 to be rotatable about rotation shaft 102, stirring the toner inside toner stirring portion 92 and carrying the toner to toner discharging portion 90; and upper lid 88 or 288 having a recess 109 or 209, formed to surround, like a tunnel, the toner discharging member 82 above outlet 72, together with partition wall 94 and the inner wall of toner holding container 80 or 280.

Therefore, entrance of air to toner T around outlet 72 from above outlet 72 becomes less likely and, therefore, accidental leakage of toner T from outlet 72 can be prevented when toner is not replenished, that is, when rotations of toner discharging member 82 and toner stirring member 84 are stopped. Therefore, the amount of toner T replenished to developing device 40 can accurately be controlled.

Further, as the inner space of container 86 is separated in the horizontal direction to toner discharging portion 90 and toner stirring portion 92 by partition wall 94, the toner discharging member 82 does not much receive the weight (gravity) of toner contained in the toner stirring portion 92. Therefore, the stress imposed on the toner by friction with toner discharging member 82 can be reduced, and degradation of toner characteristics can be prevented.

Further, in the embodiment described above, outlet 72 is formed at a position corresponding to the center in the axial direction of toner discharging member 82. Therefore, different from when it is formed at a position corresponding to an end in the axial direction, it becomes possible to open opposite ends of the portion surrounding like a tunnel. Therefore, it becomes possible to prevent toner from being locally accumulated near the end in the axial direction of toner discharging member 82. As a result, particularly when the toner cartridge is transported, failure of rotation caused by toner clogged in a bearing supporting the toner discharging member 82 can be prevented.

Further, in the embodiment described above, the spiral of toner carrying unit 98 is inclined in such a direction that the toner is carried from axially opposite ends of toner discharging member 82 toward the outlet 72. Therefore, the toner is carried in two directions toward outlet 72, and as compared with an example in which toner is carried only in one direction, the amount of air entering from above outlet 72 can further be reduced. As a result, accidental leakage of toner from outlet 72 can more effectively be prevented. Further, it is possible to decrease number of rotations and rotation speed of toner discharging member 82 and, therefore, load imposed on the toner at the terminating end of toner carrying direction can be reduced. As a result, agglomeration of toner and undesired entrance of external additive to the inside of toner can be prevented, and therefore, toner with degraded characteristics can be reduced.

Further, in the above-described embodiment, developing device 40 includes toner cartridge 60 or 260 as such and, therefore, the density and amount of toner in developing device 40 can be kept constant. As a result, a toner image with stable toner density can be formed.

Further, in the embodiment described above, image forming apparatus 20 includes the developing device 40 as such and, therefore, an image of stable, high image quality without fog or uneven image density can be formed.

Though recess 109 is formed integral with upper lid 88 of toner holding container 80 in the present embodiment, the present invention is not limited thereto. A cover member that surrounds toner discharging member 82 above and close to the outlet 72 together with partition wall 94 and the inner wall of container 86 like a tunnel may be provided separate from toner holding container 80. In the present embodiment, such a cover member is formed integral with upper lid 88 of toner holding container 80, to simplify the assembly of toner cartridge 60.

Further, though image forming apparatus 20 forming a monochrome or single color image is used in the present embodiment, it is not limiting, and the toner cartridge having the structure described above may be applied to an image forming apparatus forming a full-color image.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. A toner cartridge, comprising:

a toner holding container containing toner inside and having a toner outlet formed to discharge contained toner;

a partition wall separating the inside of said toner holding container to a toner discharging portion in which said toner outlet is formed, and a toner stirring portion other than said toner discharging portion;

a toner discharging member axially supported in said toner discharging portion to be rotatable about a first rotation shaft, for carrying said toner contained in said toner discharging portion to said toner outlet;

a toner stirring member axially supported in said toner stirring portion to be rotatable about a second rotation shaft, for stirring and carrying to said toner discharging portion said toner in said toner stirring portion; and a cover member in contact with an upper end of said partition wall and surrounding, together with said partition wall and said toner holding container, said toner discharging member at a portion above said toner outlet, like a tunnel.

2. The toner cartridge according to claim 1, wherein said partition wall has a height higher than a vertical upper end of said toner discharging member.

3. A developing device including a toner cartridge according to claim 2.

4. An image forming apparatus including the developing device according to claim 3.

5. The toner cartridge according to claim 1, wherein said toner outlet is formed at a position corresponding to a central portion in axial direction of said toner discharging member.

6. The toner cartridge according to claim 5, wherein said toner discharging member has a toner carrying unit formed as a spiral around the first rotation shaft; and direction of inclination of said spiral of said toner carrying unit is set such that said toner is carried from axially opposite ends of the toner discharging member toward said toner outlet.

7. A developing device including a toner cartridge according to claim 5.

8. An image forming apparatus including the developing device according to claim 7.

9. The toner cartridge according to claim 1, wherein said cover member is provided on an upper inner wall of said toner holding container, and formed such that on a phantom plane parallel to the longitudinal and height directions of said toner holding container, a bottom corner of said cover member has a right angle.

10. The toner cartridge according to claim 9, wherein on a phantom plane parallel to the longitudinal and height directions of said toner holding container, an angle formed by a line connecting one end of an opening of said toner outlet and one end of the bottom of said cover member at a closest position to said one end and the bottom surface of said toner holding container is formed to be smaller than an angle of repose of the toner.

11. A developing device including a toner cartridge according to claim 9.

12. An image forming apparatus including the developing device according to claim 11.

13. The toner cartridge according to claim 1, wherein said cover member is provided on an upper inner wall of said toner holding container, and formed such that on a phantom plane parallel to the longitudinal and height directions of said toner holding container, a bottom corner of said cover member has an acute angle.

14. The toner cartridge according to claim 13, wherein on a phantom plane parallel to the longitudinal and height directions of said toner holding container, an angle formed by a line connecting one end of an opening of said toner outlet and one end of the bottom of said cover member at a closest position to said one end and the bottom surface of said toner holding container is formed to be smaller than an angle of repose of the toner.

15. A developing device including a toner cartridge according to claim 13.

16. An image forming apparatus including the developing device according to claim 15.

17. A developing device including a toner cartridge according to claim 1.

18. An image forming apparatus including the developing device according to claim 17.

19. The toner cartridge according to claim 1, wherein an area of a bottom surface of the cover member is three to four times larger than an area of said toner outlet.

20. A toner cartridge, comprising:

a toner holding container containing toner inside and having a toner outlet formed to discharge contained toner;

a partition wall separating the inside of said toner holding container to a toner discharging portion in which said toner outlet is formed, and a toner stirring portion other than said toner discharging portion;

a toner discharging member axially supported in said toner discharging portion to be rotatable about a first rotation shaft, for carrying said toner contained in said toner discharging portion to said toner outlet;

a toner stirring member axially supported in said toner stirring portion to be rotatable about a second rotation shaft, for stirring and carrying to said toner discharging portion said toner in said toner stirring portion; and a cover member surrounding, together with said partition wall and said toner holding container, said toner discharging member at a portion above said toner outlet, like a tunnel, wherein, said cover member is provided on an upper inner wall of said toner holding container, and formed such that on a phantom plane parallel to the longitudinal and height directions of said toner holding container, a bottom corner of said cover member has a right angle, and wherein, on a phantom plane parallel to the longitudinal and height directions of said toner holding container, an angle formed by a line connecting one end of an opening of said toner outlet and one end of the bottom of said cover member at a closest position to said one end and the bottom surface of said toner holding container is formed to be smaller than an angle of repose of the toner.

21. A toner cartridge, comprising:

a toner holding container containing toner inside and having a toner outlet formed to discharge contained toner;

a partition wall separating the inside of said toner holding container to a toner discharging portion in which said toner outlet is formed, and a toner stirring portion other than said toner discharging portion;

a toner discharging member axially supported in said toner discharging portion to be rotatable about a first rotation shaft, for carrying said toner contained in said toner discharging portion to said toner outlet;

a toner stirring member axially supported in said toner stirring portion to be rotatable about a second rotation shaft, for stirring and carrying to said toner discharging portion said toner in said toner stirring portion; and a cover member surrounding, together with said partition wall and said toner holding container, said toner discharging member at a portion above said toner outlet, like a tunnel, wherein, said cover member is provided on an upper inner wall of said toner holding container, and formed such that on a phantom plane parallel to the longitudinal and height directions of said toner holding container, a bottom corner of said cover member has an acute angle, and wherein, on a phantom plane parallel to the longitudinal and height directions of said toner holding container, an angle formed by a line connecting one end of an opening of said toner outlet and one end of the bottom of said cover member at a closest position to said one end and the bottom surface of said toner holding container is formed to be smaller than an angle of repose of the toner.

* * * * *